US007640858B1

(12) United States Patent
Herbage et al.

(10) Patent No.: US 7,640,858 B1
(45) Date of Patent: Jan. 5, 2010

(54) STACKED PELLET FLARE ASSEMBLY AND METHODS OF MAKING AND USING THE SAME

(75) Inventors: David W. Herbage, Jackson, TN (US); John W. Dailey, Huachuca City, AZ (US)

(73) Assignee: Kilgore Flares Company, LLC, Toone, TN (US)

( * ) Notice: Subject to any disclaimer, the term of this patent is extended or adjusted under 35 U.S.C. 154(b) by 990 days.

(21) Appl. No.: 10/763,789

(22) Filed: Jan. 23, 2004

(51) Int. Cl.
*F42B 4/26* (2006.01)

(52) U.S. Cl. ..... 102/336; 102/345

(58) Field of Classification Search ..... 102/336, 102/338, 345, 346, 334, 335, 340, 342, 351, 102/357, 364, 505, 288, 361; D22/112
See application file for complete search history.

(56) References Cited

U.S. PATENT DOCUMENTS

| | | | | | |
|---|---|---|---|---|---|
| 1,758,358 | A * | 5/1930 | Ennis | 102/317 |
| 3,264,997 | A * | 8/1966 | Michael | 102/283 |
| 4,314,509 | A * | 2/1982 | Dalet | 102/288 |
| 4,391,197 | A * | 7/1983 | Jacobsen et al. | 102/334 |
| 4,408,534 | A * | 10/1983 | Araki et al. | 102/288 |
| 4,624,186 | A * | 11/1986 | Widera et al. | 102/336 |
| 5,372,069 | A * | 12/1994 | Hart et al. | 102/288 |
| 5,483,896 | A * | 1/1996 | Hock et al. | 102/530 |
| 5,499,582 | A * | 3/1996 | Schiessl et al. | 102/334 |
| 5,593,181 | A * | 1/1997 | Walker et al. | 280/741 |
| 5,648,637 | A * | 7/1997 | Clark, III | 102/438 |
| 5,730,462 | A * | 3/1998 | Jackson et al. | 280/741 |
| 5,763,820 | A * | 6/1998 | Philpot et al. | 102/531 |
| 5,915,694 | A * | 6/1999 | Brum | 273/359 |
| 6,055,909 | A * | 5/2000 | Sweeny | 102/336 |
| 6,092,467 | A * | 7/2000 | Brice | 102/336 |
| 6,161,482 | A * | 12/2000 | Clark | 102/532 |
| 6,499,407 | B2 * | 12/2002 | Brum | 102/505 |
| 6,510,798 | B2 * | 1/2003 | Brum | 102/505 |
| 6,899,033 | B2 * | 5/2005 | Marietta | 102/361 |
| 7,441,503 | B1 * | 10/2008 | Callaway | 102/336 |
| 2004/0011235 | A1 * | 1/2004 | Callaway et al. | 102/336 |
| 2006/0060103 | A1 * | 3/2006 | Koch et al. | 102/370 |
| 2007/0295236 | A1 * | 12/2007 | Callaway et al. | 102/336 |

FOREIGN PATENT DOCUMENTS

GB 2387430 A * 10/2003

* cited by examiner

*Primary Examiner*—Michael Carone
*Assistant Examiner*—Benjamin P Lee
(74) *Attorney, Agent, or Firm*—Wyatt, Tarrant & Combs, LLP; H. Roy Berkenstock; Sarah Osborn Hill

(57) ABSTRACT

The present invention relates to a flare pellet assembly for generating visual and/or infrared energy output, and to methods of making and using the same. The flare pellet assembly generally includes a stack of flare pellets, the individual pellets of which may exhibit an at least generally tapering geometry. These flare pellets may be stacked in a manner that substantially prevents motion of one flare pellet relative to another flare pellet. This stacked arrangement of the flare pellets, along with one or more grooves that may be defined in and/or between adjacent flare pellets, may be said to at least generally enable the resultant flare pellet assembly to provide one or both infrared and visual energy output that reaches desired countermeasure energy output specifications without sacrificing structural integrity of the flare pellet assembly.

10 Claims, 12 Drawing Sheets

| TEST # | FORM FACTOR | TYPE | PEAK LIGHT OUPUT, candela | PEAK IR OUTPUT, SHORT BAND, w/ster | PEAK IR OUTPUT, MID BAND, w/ster | DURATION @ 50% OF Peak, sec. |
|---|---|---|---|---|---|---|
| 1 | 1 X 1 X 8 | IR FLARE | 384,952 | no data | no data | |
| 2 | 1 X 1 X 8 | IR FLARE | 384,952 | 16,346 | 27,083 | |
| 3 | 1 X 2 X 8 | IR FLARE | 641,587 | 27,192 | 40,896 | |
| 4 | 2 X 2 1/2 X 8 | IR FLARE | 1,026,540 | 71,497 | 119,907 | |
| 5 | 1 X 2 X 8 | VIS. FLASH FLARE | 8,725,587 | 14,769 | 22,874 | 0.38 |
| 6 | 1 X 2 X 8 | VIS. FLASH FLARE | 10,906,984 | 14,615 | 24,412 | 0.4 |
| 7 | 1 X 2 X 8 | VIS. FLASH FLARE | 10,778,667 | 19,269 | 26,548 | 0.38 |
| 8 | 1 X 2 X 8 | IR FLASH FLARE | 1,924,762 | 112,603 | 148,724 | 0.4 |
| 9 | 1 X 2 X 8 | IR FLASH FLARE | 1,668,127 | 106,004 | 145,281 | 0.46 |

Fig. 7

Fig. 8
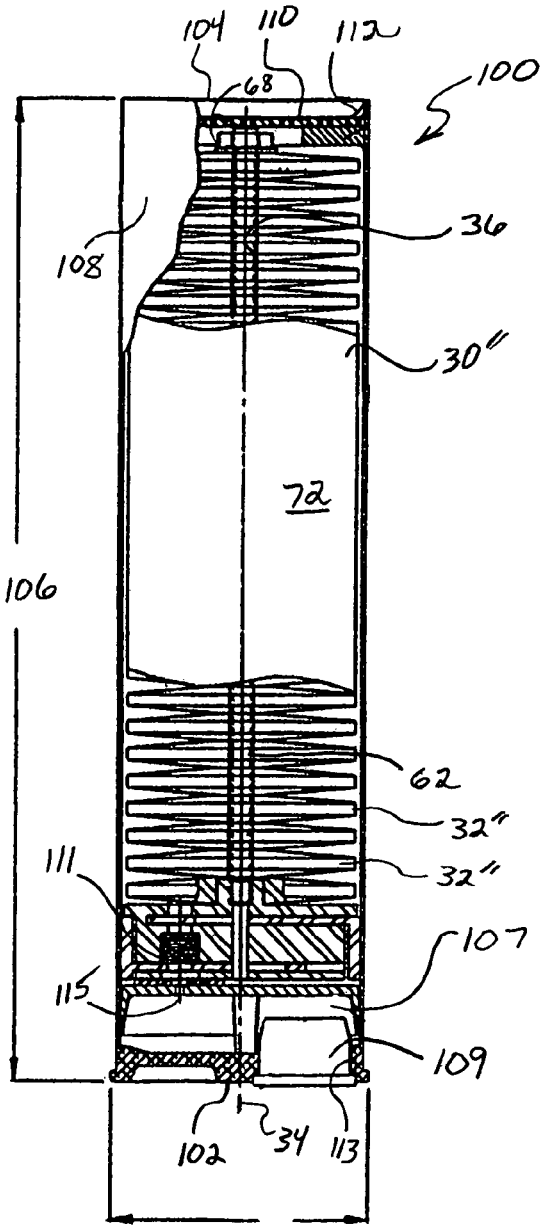
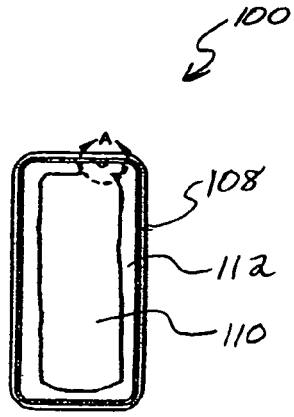
Fig. 9A
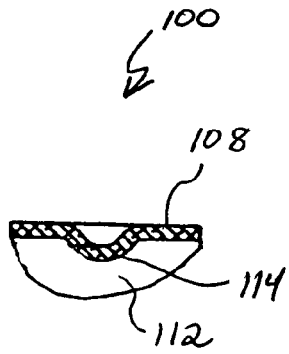
Fig. 9B

STACKED PELLET FLARE ASSEMBLY AND METHODS OF MAKING AND USING THE SAME

STATEMENT REGARDING SPONSORED RESEARCH OR DEVELOPMENT

Not applicable.

REFERENCE TO A MICROFICHE APPENDIX

Not applicable.

FIELD OF THE INVENTION

The present invention relates to decoy flares and, more particularly to a new pellet design and arrangement for countermeasure flares and other pyrotechnic devices.

BACKGROUND OF THE INVENTION

Flare assemblies have been and continue to be utilized in various manners as defensive countermeasures. For instance, what may be characterized as "visual" flash flares have been utilized to at least generally distract, startle, and/or "throw off" a person responsible for guiding and/or aiming a missile, such as a laser guided missile, at an object, such as a tank or an airplane. A general premise behind these visual flash flares is that enough light in the visual wavelengths will be emitted via ignition of the associated payload that a person responsible for guiding and/or aiming a missile cannot help but be distracted by the magnitude of light produced. As one might expect from the magnitude of the desired output intensity, these visual flash flares typically exhibit a burn time of no more than about a couple seconds.

Conventional visual flash flares have typically included an ejectable payload made up of a loose or loosely packed, ignitable, granular composition. This granular payload composition has become undesirable for numerous reasons. For instance, low packing density exhibited by the granular compositions, inherent in some conventional visual flash flares, may result in to low energy density of the flare. As another detriment, transportation and storage of these types of flares may be expensive and has provided undesired detonation problems. These drawbacks, as well as others, seem to have made military units reluctant to employ these types of visual flash flare devices on board their aircraft.

Other prior art flare assemblies may be utilized to distract or "confuse" an infrared guided missile's guidance system into locking in on the infrared light from the flare assembly rather than the exhaust/plume of an aircraft. In this manner, flare assemblies have been utilized to decoy infrared guided missiles at least generally away from an aircraft. FIGS. 1A-B illustrate an example of a prior art flare pellet 20 utilized in infrared flare assemblies. These flare assemblies typically include one, and only one, flare pellet 20 that is generally press-formed to exhibit slightly smaller dimensions than the fully assembled flare. That is, the pellet 20 generally has a length 21, width 22, and depth (or thickness) 24 that is slightly smaller than the corresponding dimensions of the fully assembled flare. Eight longitudinal grooves 26 are defined in the outer surface 28 of the pellet 20 and run at least generally parallel to a longitudinal reference axis 23 of the pellet 20. These grooves 26 are generally included to increase an initial surface area of the flare pellet 20 for ease of igniting and to generally control the energy output of the flare pellet 20 upon ignition. However, the design of this flare pellet 20 has not provided desired output energy versus burn time performance when used in conjunction with certain spectrally balanced infrared flare formulations. That is, the flare pellet 20 has provided burn times that are longer than desired and energy outputs that are less than desired. This due, at least in significant part, to the flare pellet exhibiting a greater web than desired. Herein, "web" generally refers to a distance between the outer surface 28 of the pellet 20 and a portion of the pellet 20 which is generally found to be the last portion to burn. For example, a web of the pellet 20 of FIGS. 1A-B may refer to a distance 25 between a trough of the groove 26*a* and a lateral reference axis 27. To provide an idea of the web magnitude of the pellet 20, this distance 25 has generally been about 0.25 inch.

Past attempts to modify the design of the flare pellet 20 to increase its initial surface area and/or to decrease the magnitude of the web, with the goal of increasing its peak output energy level and reducing its burn time, have resulted in flare pellets having insufficient structural integrity resulting in fragmenting and/or breaking of the pellet 20 during normal launch, flight movement/vibration. For instance, holes have been drilled in various flare pellets to increase their surface area and, thus, the peak energy output of the flare pellets. However, these designs have broken apart or collapsed upon having an appropriate ejection force imposed thereon and/or have jammed in the flare launcher. Accordingly, these past attempts have provided insufficient and inconsistent results.

Developments in infrared guided missile technology have enabled guidance systems of missiles to discriminate and reject spectral signatures of some conventional flare assemblies utilized in defensive countermeasures. Any detected spectral signal in which the band intensities and/or band ratios do not conform to a particular target aircraft's distinctive signature would be "ignored" by the missile's guidance system. Accordingly, it is beneficial to provide countermeasure flares capable of providing a spectral signature similar to that of aircraft desired to be defended. To date, certain energetic compositions of spectrally balanced flare assemblies do not burn fast enough to give the desired results. Conventional approaches have not successfully reformulated the compositions to be faster burning without sacrificing spectral balance, structural integrity, safe storage, and/or safe transport.

Another example of a conventional flare is what may be referred to as a standard illumination flare assembly that includes a single cast or pressed flare pellet that has and outside circumference and one end inhibited from burning. These flare pellets are generally ignited on one end and burn from end-to-end. These types of standard illumination flare assemblies typically have burn times that are an order of magnitude higher than decoy flares, typically ranging from tens of seconds to one or more minutes. However, in exchange for the length of the burn time, these flares typically do not exhibit sufficient magnitudes of visual light output to distract weapons operators.

SUMMARY OF THE INVENTION

It is an object of the present invention to provide a flare pellet geometry that will safely, with good physical integrity, yield faster (e.g., shorter) burn times and higher peak output levels with any given flare composition in any given form factor than any prior art pressed, extruded, or cast flare pellet. These attributes are achieved without the negative attributes (e.g., hazards) associated with the use of granular or powdered compositions, which are known to have been used in lieu of pressed, cast, or extruded flare pellets. These attributes are achievable with a variety of pyrotechnic flare compositions such as visual flare compositions, conventional magnesium/polytetrafluoroethylene infrared flare compositions, spectrally balanced infrared flare compositions, and others.

Herein, the term "flare pellet geometry" generally refers to a stacked arrangement of the pellets that make up the entire flare pellet as well as the individual pellets that make up the pellet stack assembly. Accordingly, "flare pellet geometry," as applied to prior art flare pellets, includes the entire pressed, cast or extruded flare pellet including all of its surface features. "Flare pellet geometry" may refer to the dimensional features of the unit load pyrotechnic and especially those features that make up the initial combustible surfaces of the unit load pyrotechnic.

It is another object of the present invention to provide a flare pellet assembly that does not degrade desired spectral signatures. It is yet another object of the present invention to provide a flare pellet assembly that is capable of maintaining structural integrity throughout normal flight movement and/or vibrations as well as normal ejection forces. It is still another object of the present invention to provide a flare pellet assembly that is capable of being tailored to replicate an exhaust plume of any of a number of appropriate aircraft. These objectives, as well as others, may be met by the countermeasure system and related methods herein described.

In one aspect, the present invention is directed to a flare pellet assembly for use in a defensive countermeasure. This flare pellet assembly generally includes at a plurality of ignitable flare pellets that are arranged in a stack. This stacked arrangement of the flare pellets, along with one or more grooves that may be defined in and/or between adjacent flare pellets, at least generally enable the resultant flare pellet assembly to provide one or both infrared and visual output that reach desired countermeasure specifications. Moreover, this stacking of the individual flare pellets enables the resultant flare pellet assembly to structurally withstand normal in flight vibration as well as ejection forces such as those forces imposed on the flare pellet assembly when ejected from a flare launcher system.

These flare pellets of the invention may exhibit any appropriate geometric shape. For instance, one or more of the flare pellets may be substantially disk shaped. Further, the flare pellets may exhibit any appropriate design/configuration. As another example, one or more of the flare pellets may exhibit a frustum of a cone or pyramid as well as other appropriate configurations. Yet further, the flare pellets may have any appropriate dimensions. For instance, one or more of the flare pellets may include a thickness of about 0.225 inch, a length of about 1.88 inch, and/or a width of about 0.845 inch. In the case that at least one of the flare pellets is substantially disk shaped, the flare pellet(s) may have a thickness of about 0.30 inch and/or a diameter of about 1.98 inch. While numerous designs, shapes, and dimensions of the flare pellets of the flare pellet assembly may be appropriate, it is preferred that the individual flare pellets are substantially identical in size and general design. Moreover, while some embodiments of the flare pellet may be compatible with a number of appropriate form factors, preferred embodiments of the flare pellet assembly are compatible with at least one of a 1×1×8 inch form factor, a 1×2×8 inch form factor, a 2×2.5×8 inch form factor, a 55 mm diameter form factor, and a 36 mm form factor. Incidentally, a "form factor" is a term of art generally referring to a compatibility between flare pellet assemblies and flare casings or flare assemblies and dispensing systems. For example, a flare pellet assembly and a flare casing having the same form factor can be used together.

One family of embodiments of the flare pellet assembly may be characterized by having first and second flare pellets that are substantially immobilized relative to each other. For instance, in one embodiment, the first and second flare pellets may be at least generally affixed to each other using an appropriate adhesive and/or mechanical fastener(s). In another embodiment, the first and second flare pellets may be at least generally keyed to each other. In other words, the flare pellets may have at least generally complimentarily surfaces including lands and/or grooves configured to engage each other. This keyed design of the flare pellets at least generally fosters an immobilization of the flare pellets relative to each other in at least one direction.

The flare pellet assembly, at least in one family of embodiments, may be said to include a rod or beam that extends through a plurality of the flare pellets. In this family of embodiments, rotation of one or more of the flare pellets relative to the rod may be restricted, and preferably, substantially prevented. For instance, the flare pellet(s) of one embodiment may be affixed to the rod in any of a number of appropriate manners, such as by employing an appropriate adhesive. Another embodiment may have at least one protrusion associated with either the rod or the flare pellet(s) and a recess, complimentarily configured to accommodate the protrusion, associated with the other of the rod and the flare pellet(s). Incidentally, it should be noted that other embodiments may have a rod that includes both a protrusion and a recess, and the flare pellet(s) may also have a protrusion and a recess complimentarily configured to engage and/or be engaged by the protrusion and recess associated with the rod.

Some flare pellet assemblies including a rod may be equipped with a stop of sorts, such as a head, at one end and threading at the other end thereof. The flare pellet assembly may also include a threaded fastener engaged with the threading of the second end of the rod. In this arrangement, it may be said that a plurality of the flare pellets are at least generally disposed between the stop of the rod and the threaded fastener. This arrangement at least generally facilitates a maintenance of the stacked configuration of the flare pellets of the flare pellet assembly.

Another aspect of the present invention is directed to a flare pellet assembly that includes a flare pellet having a longitudinal reference axis and made of at least one ignitable material. Moreover, at least one tapered groove is defined in the flare pellet and at least generally tapers toward the longitudinal reference axis.

The tapered groove(s) of the flare pellet may include an interior angle of between about 5° and about 35°. So, for instance, the tapered groove(s) may have an interior angle of about 10° in one embodiment and about 20° in another embodiment. The tapered groove(s) may have any of a variety of appropriate arrangements. For example, the tapered groove (s) may be annularly disposed about the longitudinal reference axis. In at least one embodiment, the flare pellet may be said to include first and second flare pellets. In such an embodiment, the tapered groove may be defined between the first and second flare pellets.

In yet another aspect, the present invention is directed to a method of using a flare assembly, such as a visual flash flare assembly. In this method, a pellet assembly is ejected from a flare assembly. This pellet assembly generally is made up of an ignitable material that includes between about 40% and about 70% magnesium, between about 20% and about 50% sodium nitrate, and may optionally include plastic binder material such as Laminac™. In addition to ejection of the pellet assembly, the pellet assembly is ignited, and a visual light output reaching at least about 5.0 million candela is provided.

An infrared output of the pellet assembly may reach at least about 14,000 w/ster (watts per steradian) in the short infrared band (e.g., an infrared band between about 1.811 and about 0.3μ), and/or at least about 22,000 w/ster in the mid infrared band (e.g., an infrared band between about 3.0μ and about 5.5μ). Incidentally, "reach" or the like herein generally means to meet or exceed a value or magnitude. In one embodiment, the pellet assembly may have a first infrared output that reaches at least about 10,000 w/ster in the short infrared band and a second infrared output in the mid infrared band.

Yet another aspect of the present invention is directed to a method of using a flare assembly, such as an infrared flash flare assembly. In this method, a pellet assembly made from an ignitable material that includes magnesium, polytetrafluoroethylene, and a fluoroelastomer, is ejected from a flare assembly and ignited.

In one embodiment, an infrared output is generally provided that is at least about 90,000 w/ster in the short infrared band. In another embodiment, an infrared output of at least about 130,000 w/ster in the mid infrared band is generally provided. Still another embodiment may include a step of providing a first infrared output in the short infrared band and a second infrared output in the mid infrared band as a result of igniting the pellet assembly.

Yet another aspect of the present invention is directed to a method of using a flare assembly, such as what may be characterized as a spectrally-balanced flare assembly. In this method, a pellet assembly is ejected from a flare assembly and ignited. As a result of igniting the pellet assembly, first infrared output associated with the pellet assembly is at least about 6,000 w/ster in the mid infrared band for a duration of at least about 2.0 seconds.

The first infrared output may reach a peak infrared output of at least about 7,000 w/ster in one embodiment, at least about 7,500 w/ster in another embodiment, and at least about 8,000 w/ster in yet another embodiment. In one embodiment, a second infrared output of at least about 2,000 w/ster may be reached in the short infrared band during the above-mentioned duration of time.

Various refinements may exist of the features noted in relation to the above-disclosed aspects of the present invention. Further features may also be incorporated in these aspects of the present invention as well. These refinements and additional features may exist individually or in any combination. Moreover, each of the various features discussed herein in relation to one or more of the disclosed aspects of the present invention may generally be utilized by any other aspect(s) of the present invention as well, alone or in any combination.

BRIEF DESCRIPTION OF THE DRAWINGS

FIG. 7 is a spreadsheet illustrating various outputs of prior art infrared flares, visual flash flares of the invention, and infrared flash flares of the invention.

FIG. 8 is a cut-away plan view of a flare assembly including yet another embodiment of a flare pellet assembly of the invention.

FIG. 9A is an end view of the flare assembly of FIG. 8.

FIG. 9B is a magnified view of the circled area "A" of FIG. 9A.

DETAILED DESCRIPTION OF THE DRAWINGS

Figure 2:
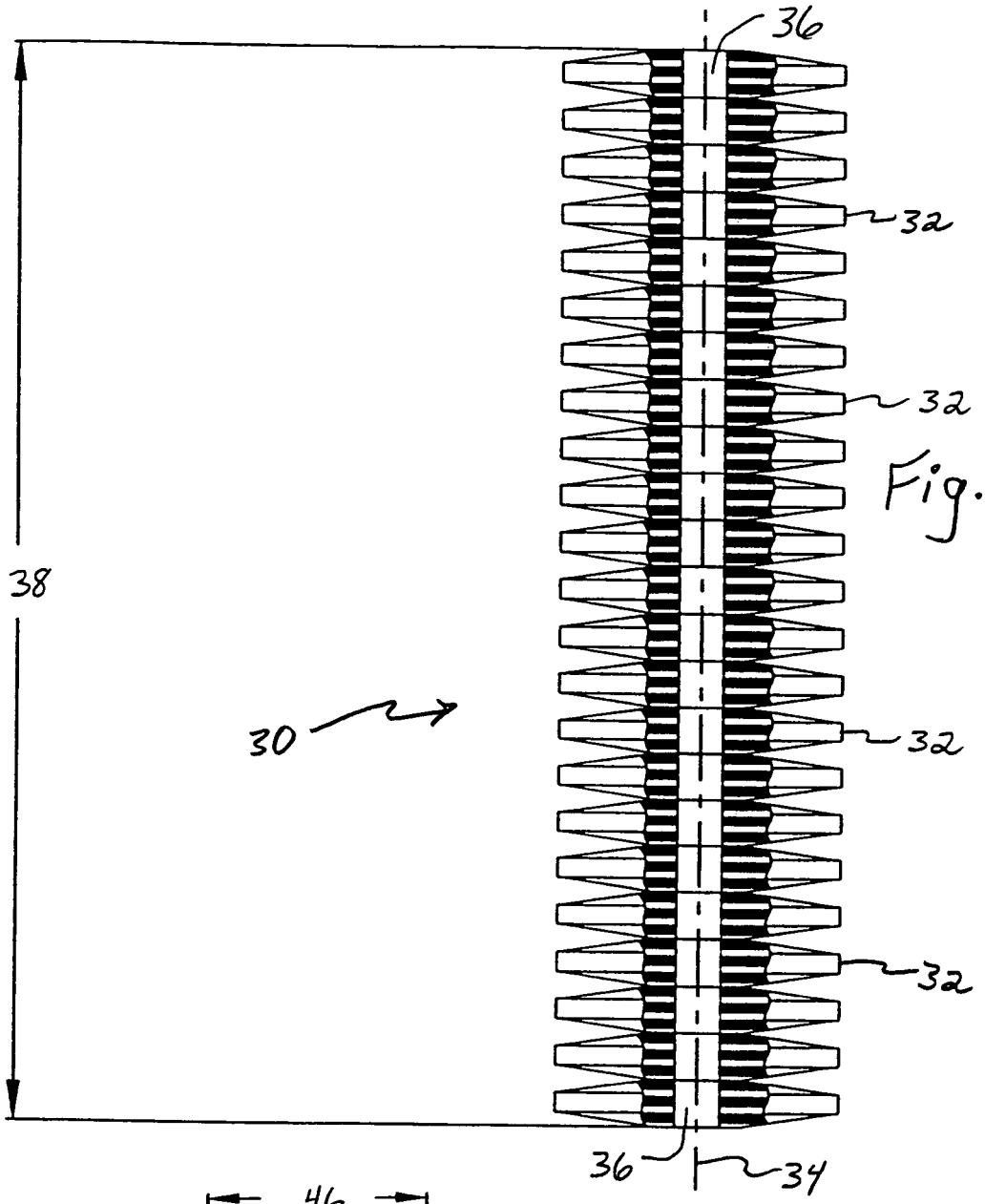
FIG. 2 is a cut-away plan view of one embodiment of a flare pellet assembly of the invention.

The present invention will now be described in relation to the accompanying drawings, which at least assist in illustrating the various pertinent features thereof. FIG. 2 illustrates a flare pellet assembly 30 for use in a pyrotechnic device such as a defensive countermeasure. This flare pellet assembly 30 is shown as including at a plurality of flare pellets 32 that are arranged in a stack at least generally along a longitudinal reference axis 34. While the flare pellet assembly 30 is illustrated as including twenty-three flare pellets 32, it should be noted that other numbers of flare pellets 32 may be incorporated in other embodiments of the flare pellet assembly 30. Moreover, the flare pellet assembly 30 may exhibit any appropriate length 38 depending on such things as, for example, the desired overall length of the completed flare assembly the desired energy output of the assembly 30, the dimensions of the individual flare pellets 32, and the number of flare pellets 32 included in the assembly 30. In any event, the flare pellet assembly 30 is shown as having an aperture 36 that extends through each of the pellets 32 and that is defined along the reference axis 34. This aperture 36 may extend up to a substantial entirety of the length 38 of the assembly 30 or may only extend along a portion of the length 38 of the assembly 30. The aperture 36 may be utilized, as shown in subsequent embodiments, to accommodate an appropriate mechanical fastener that at least generally assists in holding the flare pellets 32 of the flare pellet assembly 30 in the illustrated stacked arrangement. It should be noted, however, that other embodiments may exist which do not have an aperture 36, while other embodiments may include a plurality of apertures disposed in any of a number of appropriate locations and/or orientations.

Each of these flare pellets 32 of the flare pellet assembly 30 is made of an appropriate ignitable material. For example, in one preferred embodiment, the flare pellets 32 are made of an ignitable material including between about 40% and about 70% magnesium, between about 20% and about 50% sodium nitrate, and about 10% Laminac™ or the like. To enhance the structural integrity of each of the flare pellets 32, it is preferred that the same are manufactured by pressing, casting, molding, and/or extruding the ignitable material into the desired shape/design of the flare pellet 32. For example, FIG.

3 illustrates an exemplary flare pellet 32 that is what may be characterized as substantially disk shaped, biconvex, or at least pseudo-biconvex, and that includes a top 40, a bottom 42, and a side 44. While the flare pellet 32 is shown as having a width, or in this case, a diameter, 46 measured substantially perpendicular to the reference axis 34, and a length 48 measured substantially parallel to the reference axis 34 that generally coincides with a distance between the top 40 and the bottom 42 of the flare pellet 32. This width 46 and length 48 of the flare pellet 32 may be any appropriate distances. For example, in one preferred embodiment, the width 46 of the flare pellet 32 may be about 1.277 inches, and the length 48 of the flare pellet 32 may be about 0.216 inch. Due to the design of the flare pellet 32, a web of the same is generally equal to about half of the length 48 of the flare pellet 32.

Figure 3:
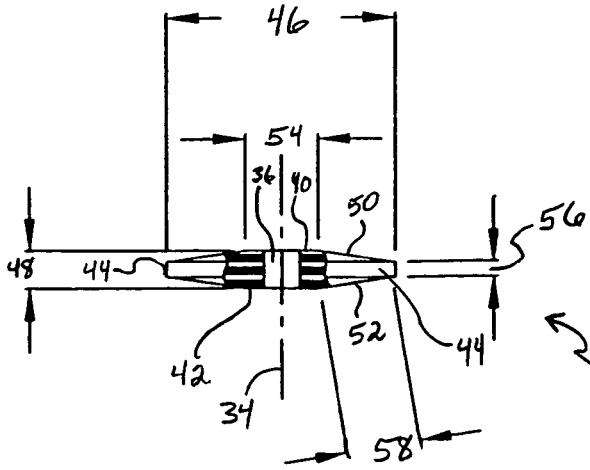
FIG. 3 is a cut-away plan view of a flare pellet of the flare pellet assembly of FIG. 2.

Still referring to FIG. 3, in addition to the top 40, bottom 42, and side 44, the flare pellet 32 also includes first and second outer surfaces 50, 52 (respectively). The first outer surface 50 at least generally spans between the top 40 of the flare pellet 32 and the side 44 of the flare pellet 32. Likewise, the second outer surface 52 of the flare pellet 32 at least generally spans between the bottom 42 of the flare pellet 32 and the side 44 of the flare pellet 32. These first and second outer surfaces 50, 52 are oriented such that it may be said that the flare pellet 32 at least generally tapers from its width 46 (measured at opposing portions of the side 44 and intersecting the reference axis 34) toward a central width 54 associated with each of the top 40 and bottom 42 of the flare pellet 32. Moreover, these first and second outer surfaces 50, 52 are oriented such that it may be said that the flare pellet 32 at least generally tapers from its length 48 (measured from the top 40 to the bottom 42 and parallel to the reference axis 34) toward a peripheral length 56 associated with side 44 of the flare pellet 32. Incidentally, a surface length 58 of each of the first and second outer surfaces 50, 52 may be any appropriate length. For example, one preferred embodiment may have first and second outer surfaces 50, 52 both having a surface length 58 of about 0.411 inch. Incidentally, while the first and second outer surfaces 50, 52 have been described as having the same surface length 58, other embodiments may exhibit first and second outer surfaces 50, 52 having differing outer surface lengths 58.

Figure 4:
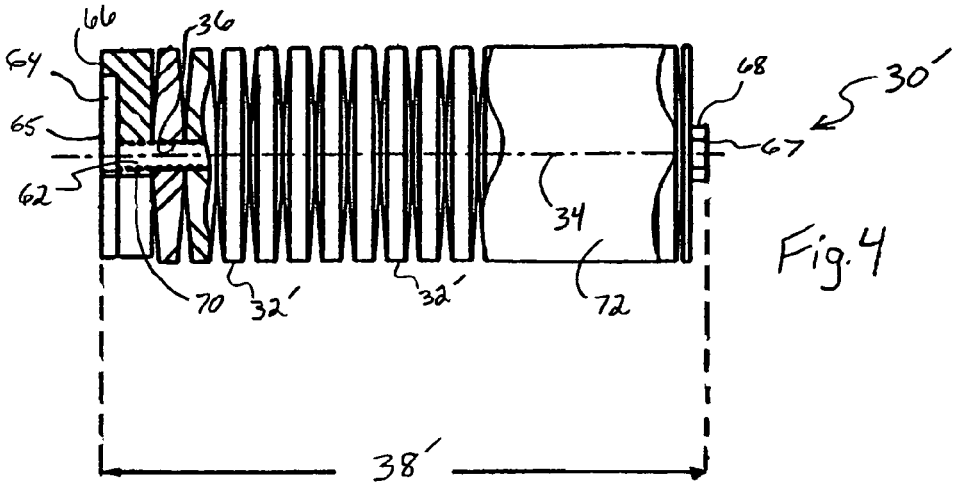
FIG. 4 is a cut-away plan view of another embodiment of a flare pellet assembly of the invention.

FIG. 4 illustrates another embodiment of a flare pellet assembly of the invention, and as such, a "single prime" designation is used to distinguish the flare pellet assembly 30', as well as various features thereof, shown in FIG. 4 from the flare pellet assembly 30 shown in FIG. 2. Like the flare pellet assembly 30 of FIG. 2, the flare pellet assembly 30' of FIG. 4 is shown as including at a plurality of flare pellets 32' that are arranged in a stack at least generally aligned with the longitudinal reference axis 34. While the flare pellet assembly 30' is illustrated as including at least twelve flare pellets 32', it should be noted that other quantities of flare pellets 32' may be incorporated in other embodiments of the flare pellet assembly 30'.

FIG. 4 illustrates that the flare pellet assembly 30' has an aperture 36 that extends through each of the pellets 32' and that is defined along the reference axis 34. Disposed at least generally within this aperture 36 is a rod 62 having a stop 64, such as a head or other appropriate stop feature, at a first end 65 thereof and threading (not shown) disposed at a second opposing end 67 thereof. The threading associated with the second end 67 of the rod 62 is preferably threadingly engaged with a threaded nut 68. In this arrangement, it may be said that the stack of flare pellets 32' are positioned at least generally between the stop 64 of the rod 62 and the nut 68. A length 38' of this flare pellet assembly 30' generally refers to a distance between the first end 65 of the rod 62 and most remote portion of one of the second end 67 of the rod 62 and the nut 68. As with the flare pellet assembly 30 illustrated in FIG. 2, this flare pellet assembly 30' may exhibit any appropriate length 38' depending on such things as, for example, the desired energy output of the assembly 30', the dimensions of the individual flare pellets 32', and the number of flare pellets 32' included in the assembly 30'. One beneficial feature of this embodiment, is that the rod 62 is preferably designed so that the desired quantity of flare pellets 32' associated with the assembly 30' are substantially prevented from any significant movement in a direction parallel to the reference axis 34. In other words, employment of this rod 62 and the nut 68 may be said to at least generally assist in longitudinally immobilizing the flare pellets 32' relative to the rod 62. Moreover, this rod 62 tends to provide structural support for the flare pellet assembly 30', and accordingly, at least generally reduces a tendency for structural damage during ejection of the flare pellet assembly 30' from a flare launcher.

Still referring to FIG. 4, in some embodiments of the flare pellet assembly 30', an appropriate base 66 may be disposed at least generally between the stop 64 of the rod 62 and the flare pellet 32' nearest the stop 64. This base may be made of any appropriate material such as aluminum or filled plastic, and may be utilized for any appropriate purpose. For example, the base 66 may be made of an appropriate shock absorbing material and may be employed to dampen at least some of the vibration associated with aircraft flight to at least generally hinder and/or prevent structural damage to the flare pellets 32'. Moreover, an appropriate washer 72 may also be disposed about the rod 62 toward the second end 67 of the rod 62. Particularly, this washer 72 may be positioned at least generally between the nut 68 and the flare pellet 32' nearest the nut 68.

FIG. 4 also illustrates that an appropriate adhesive or potting compound 70 such as, for example, epoxy or RTV (room-temperature-vulcanizing) adhesives/sealants may be employed in the flare pellet assembly 30' to at least generally assist in immobilizing various parts of the assembly 30'. More particularly, this adhesive 70 is shown as being disposed between each flare pellet 32' and the rod 62. This at least generally hinders movement of the flare pellets 32' relative to the rod 62. In addition, the adhesive 70 is disposed between the base 66 and the rod 64. Further, the adhesive 70 may also be disposed between adjacent flare pellets 32' (FIG. 5C) to at least generally hinder movement of the flare pellets 32' relative to each other. It should be noted that any number of adhesives may be employed in this flare pellet assembly 30'. For instance, a first adhesive may be disposed between the rod 62 and the flare pellets 32', a second adhesive may be disposed between the rod 62 and the base 66, and a third adhesive may be utilized between adjacent flare pellets 32'.

The flare pellet assembly 30' of FIG. 4 also includes a wrap 72 that is disposed about the stack of flare pellets 32'. This wrap 72 may be any appropriate wrap such as, but not limited to, an aluminum foil or other appropriate foil affixed to the flare pellets 32' using an appropriate adhesive or the like, such as an acrylic adhesive. Moreover, in some embodiments, this wrap 72 may also include a layer of nylon, for example, nylon tape, or other appropriate material. As one benefit of this arrangement, employment of the wrap 72 may be said to at least generally contribute to immobilizing the flare pellets 32' relative to each other. Another benefit of utilizing this wrap 72 may be to assist in the ignition of the flare pellet at high altitudes and also at high q conditions.

Each of these flare pellets 32' of the flare pellet assembly 30' of FIG. 4 is made of an appropriate ignitable material including, but not limited to, any of the ignitable materials disclosed herein. For example, in one preferred embodiment, the flare pellets 32' are made of an ignitable material including between about 50% and about 70% magnesium, between about 14% and about 34% polytetrafluoroethylene (PTFE), and about 16% Viton® or other appropriate flouroelastomer. In another preferred embodiment, the flare pellets 32' are made of an ignitable material including between about 50% and about 70% magnesium, between about 25% and about 45% PTFE, and about 5% to 10% acrylic rubber binder or other appropriate binder.

Figure 5A:
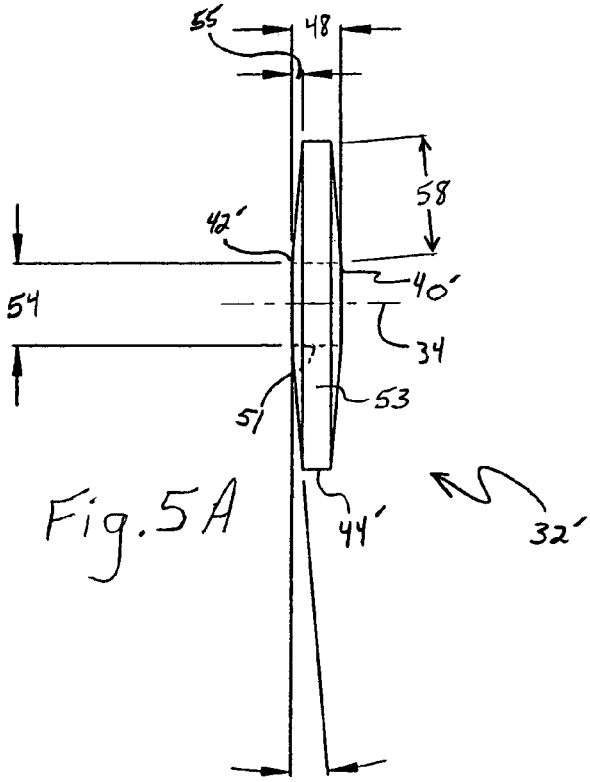
FIG. 5A is a plan view of a flare pellet of the flare pellet assembly of FIG. 4.
Figure 5B:
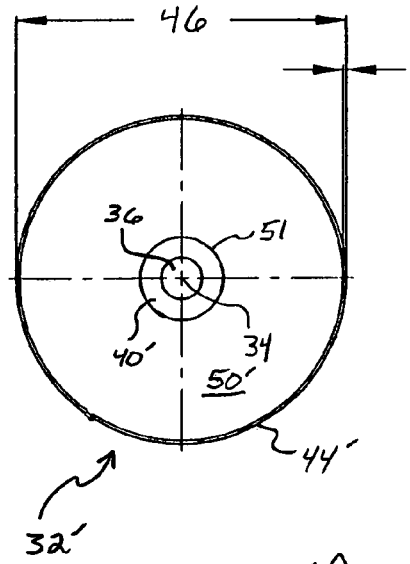
FIG. 5B is another plan view of the flare pellet of FIG. 5A.

FIGS. 5A-B illustrate a flare pellet 32' that is shaped to resemble a disk or plate and that at least generally includes some similar features of the flare pellet 32 of FIG. 3. Accordingly, unless otherwise noted, the description of the flare pellet 32 of FIG. 3 applies to this flare pellet 32'. For example, while the flare pellet 32' may exhibit any appropriate width 46 and/or length 48, in one preferred embodiment, the width 46 of the flare pellet 32' may be about 1.98 inches, and the length 48 of the flare pellet 32' may be about 0.30 inch.

Still referring to FIGS. 5A-B, the flare pellet 32' includes a first side 40', a second side 42', a circumferential side 44', and first and second outer surfaces 50', 52' (respectively). The first outer surface 50' at least generally extends between the first side 40' and the circumferential side 44' of the flare pellet 32'. Likewise, the second outer surface 52' at least generally extends between the second side 42' and the circumferential side 44' of the flare pellet 32'. These first and second outer surfaces 50', 52' are configured such that it may be said that the flare pellet 32' at least generally tapers from a first central portion 51 of the flare pellet 32' toward the circumferential side 44' of the flare pellet 32'. Indeed, it may be said that flare pellet 32' narrows by a distance 55 from the second side 42' to the circumferential side 44' and by the same distance 55 from the first side 40' to the circumferential side 44'. Another way of stating this is that the first and second surfaces 50', 52' are oriented at an angle "a" greater than 0° and less than 90° relative to a plane parallel with one or both the first and second sides 40', 42'. While this angle "α" may be any appropriate angle, in one preferred embodiment, the angle "α" is about 5°.

Still referring to the flare pellet 32' of FIGS. 5A-B, the first and second outer surfaces 50', 52' are configured such that it may be said that the flare pellet 32' at least generally tapers from a second central portion 53 toward each of the first and second sides 40', 42' of the flare pellet 32'. While, a surface length 58 of each of the first and second outer surfaces 50', 52' may be any appropriate length, the surface length 58 in one preferred embodiment is about 0.7228 inch. Incidentally, while the first and second outer surfaces 50', 52' may exhibit the same surface length 58, other embodiments may include first and second outer surfaces 50', 52' having differing outer surface lengths 58.

Figure 5C:
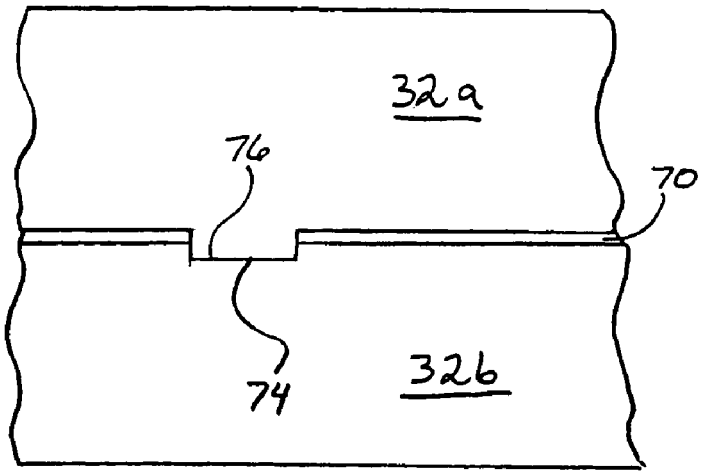
FIG. 5C is a cross-section view of first and second flare pellets that are keyed to each other.

FIG. 5C shows first and second flare pellets 32*a*, 32*b* (respectively) having adhesive 70 disposed therebetween to facilitate immobilization of the first flare pellet 32*a* relative to the second flare pellet 32*b*. This adhesive 70 may be said to promote a structural integrity of the corresponding flare pellet assembly during the imposition of ejection forces and/or in flight vibration. In addition, the flare pellets 32*a*, 32*b* are keyed to each other. That is, the first flare pellet 32*a* includes a protrusion 74 and the second flare pellet 32*b* includes a recess 76 complimentarily configured to accommodate the protrusion 74 of the first flare pellet 32*a*. Appropriate engagement of the protrusion 74 of the first flare pellet 32*a* with the recess 76 of the second flare pellet 32*b* may also contribute to immobilizing of the first flare pellet 32*a* relative to the second flare pellet 32*b*. It should be noted that any appropriate quantity of protrusions 74 and recesses 76 may be employed. Moreover, any of a number of appropriate shapes, sizes, locations, and designs of the protrusion(s) 74 and the recess(es) 76 may be utilized. And while this keying feature has been shown in combination with the use of adhesive 70, some embodiments may employ this keying feature without also utilizing the adhesive 70 between the first and second flare pellets 32*a*, 32*b*.

Figure 5D:
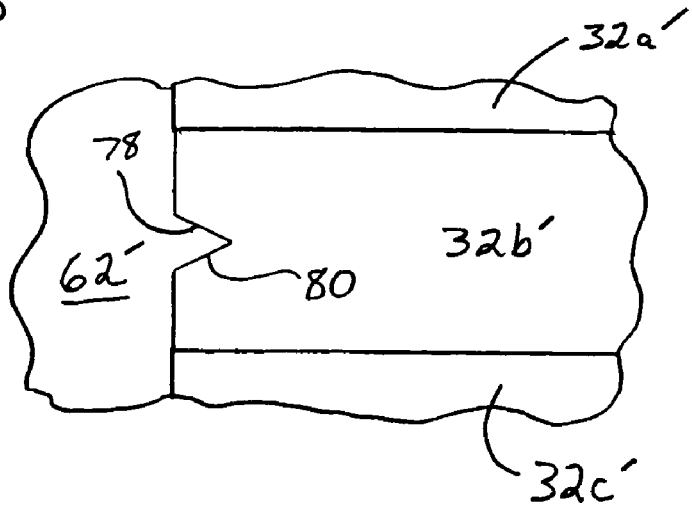
FIG. 5D is a cross-section view of a flare pellet and a rod that are keyed to each other.

FIG. 5D shows first, second, and third flare pellets 32*a*', 32*b*', 32*c*' (respectively) disposed about a rod 62'. More particularly, the second flare pellet 32*b*' and the rod 62' are keyed to each other. In other words, the rod 62' is equipped with a protrusion 78, and the second flare pellet 32*b*' includes a recess 80 complimentarily configured to accommodate the protrusion 78 of the rod 62'. Appropriate engagement of the protrusion 78 of the rod 62' with the recess 80 of the second flare pellet 32*b*' may contribute to immobilizing of the second flare pellet 32*b*' relative to the rod 62'. It should be noted that any appropriate quantity of protrusions 78 and recesses 80 may be employed. Further, other embodiments may have the second flare pellet 32*b*' including at least one protrusion 78 and the rod 62' including at least one recess 80. Yet further, any of a number of appropriate shapes, sizes, locations, and designs of the protrusion(s) 78 and the recess(es) 80 may be utilized. Still further, this keying feature may or may not be utilized in combination with the keying feature disclosed in regard to FIG. 5C.

Figure 6:
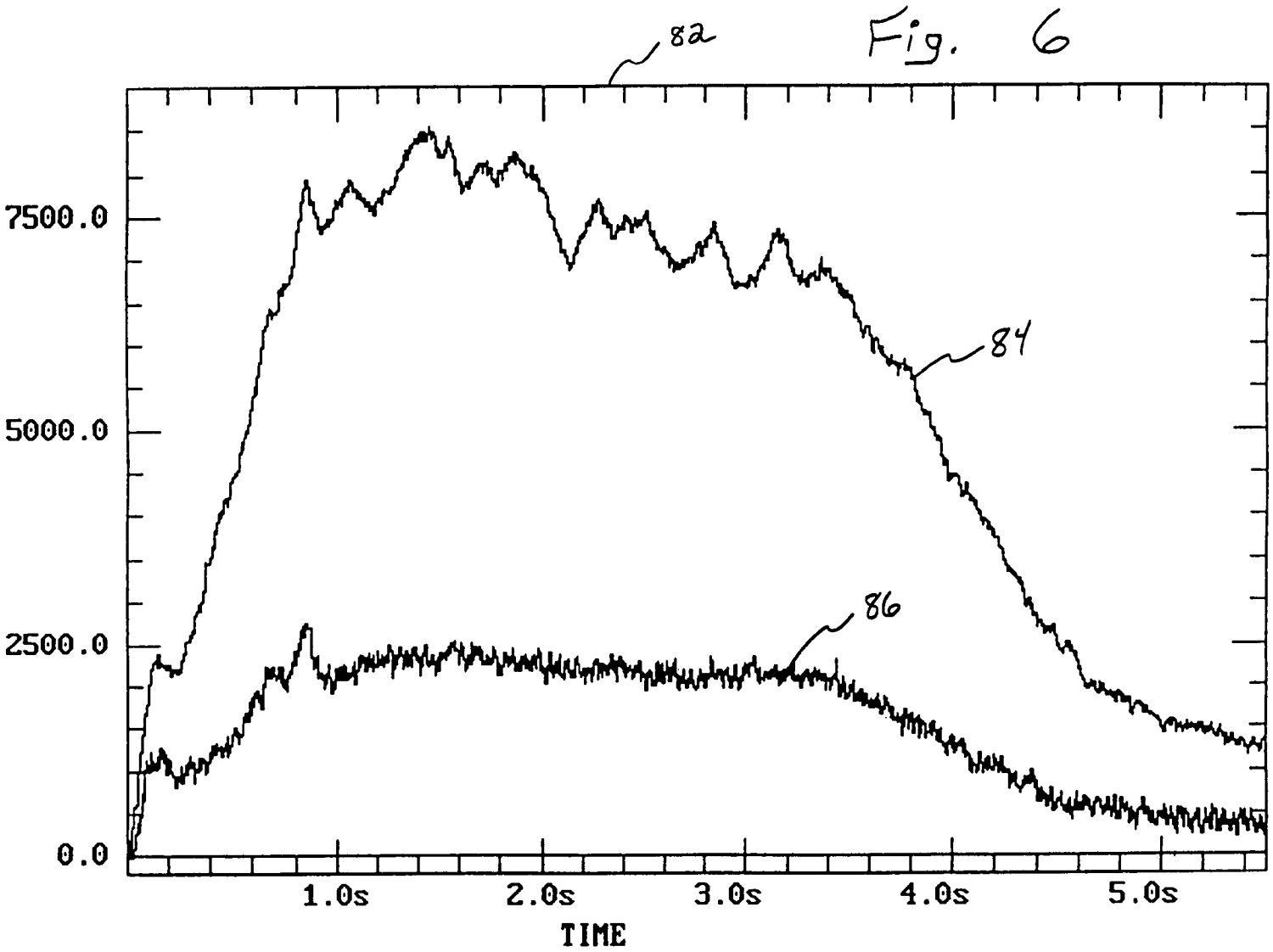
FIG. 6 is a graph illustrating magnitudes of infrared output of a spectrally balanced infrared flare employing the flare pellet assembly of FIG. 4.

FIG. 6 shows a graph 82 demonstrating first and second outputs 84, 86 (respectively) achieved using the flare pellet assembly 30' of FIG. 4. The first output 84 is indicative of energy output within the mid infrared band (e.g., a band between about 3.0μ and about 5.5μ), and the second output 86 is indicative of energy output within the short infrared band (e.g., a band between about 1.8μ and about 3.0μ). As shown, ignition of the flare pellet assembly 30' achieved a magnitude of at least about 6000 w/ster throughout a range of time spanning from about 0.7 second after ignition to about 3.6 seconds after ignition indicated by the first output 84. Moreover, ignition of the flare pellet assembly 30' achieved a magnitude of about 2000 w/ster or more throughout that same time period indicated by the second output 86. In addition, ignition of the flare pellet assembly 30' also provided a peak magnitude of about 8000 w/ster for the first output and a peak magnitude of about 2700 w/ster for the second output.

Figure 1A:
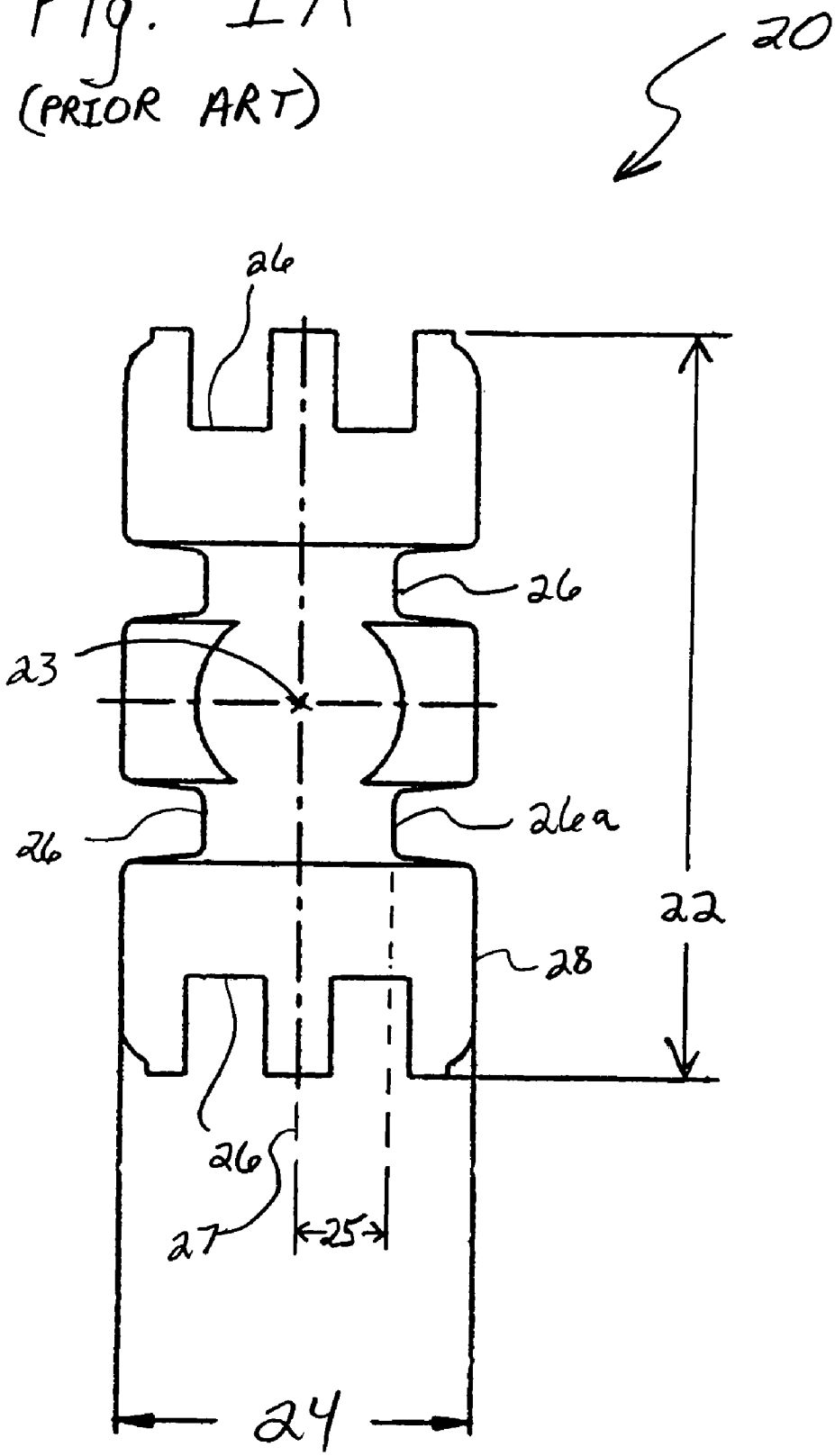
Fig. 1A (PRIOR ART)
FIG. 1A is an end view of a prior art MTV or spectrally balanced flare pellet.
Figure 1B:
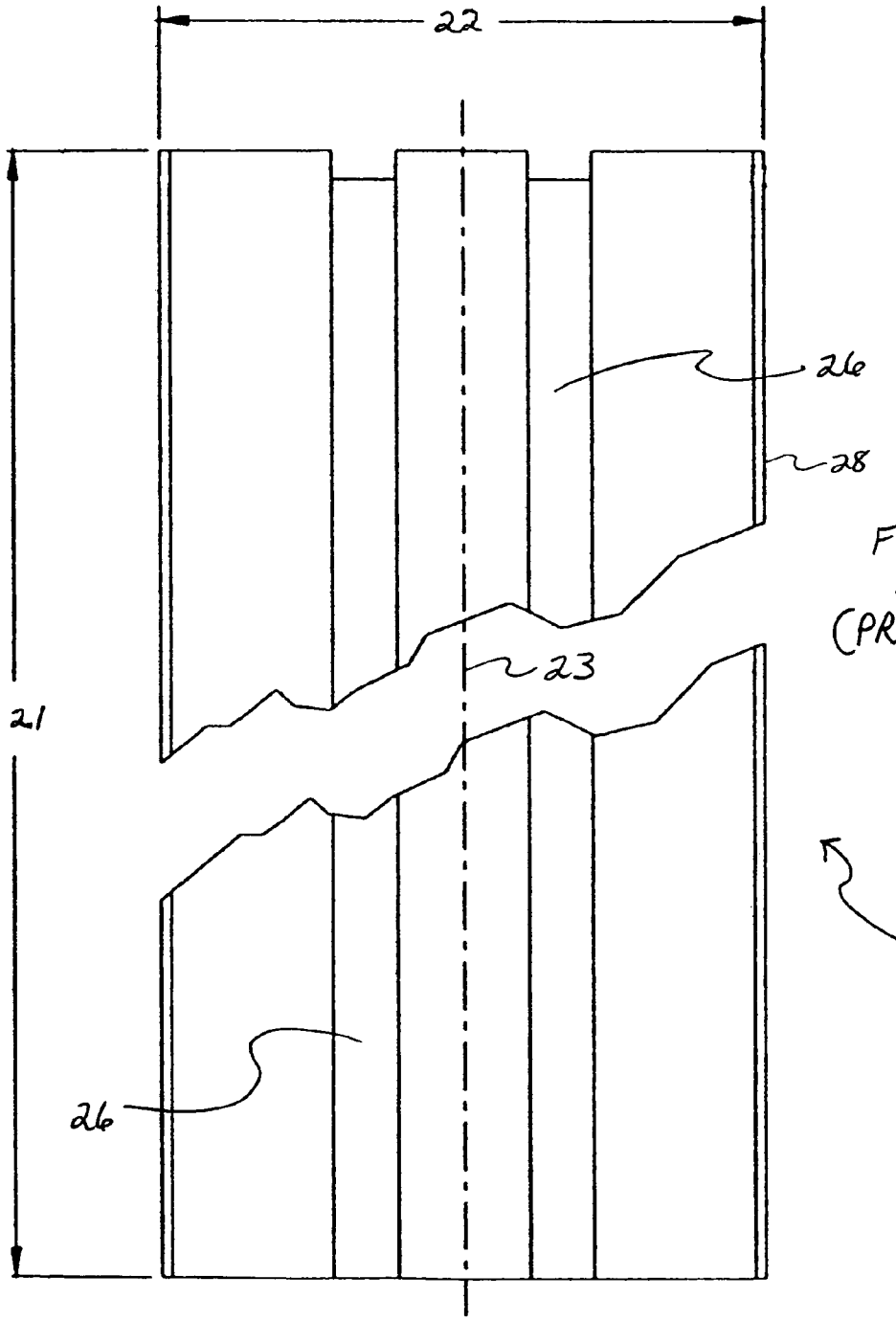
Fig. 1B (PRIOR ART)
FIG. 1B is a side view of the flare pellet of FIG. 1A.

FIG. 7 is a spreadsheet comparing output of prior art infrared flares utilizing the pellet geometry illustrated in FIGS. 1A-B (tests 1-4) with output achieved utilizing the flare pellet assembly 30' (tests 5-9). Incidentally, the form factors refer to the particular sizes of the flare assemblies and are known to those of ordinary skill in the art. Referring to tests 5-7, the design of the flare pellet assemblies of the invention has enabled these visual flares to achieve peak light outputs of more than 8.7 million candela and still be compatible with a 1×2×8 inch form factor. Moreover, tests 5-7 indicate that those visual flash flares of the invention are also capable of providing peak infrared outputs of at least 14,615 w/ster in the short infrared band and at least 22,874 w/ster in the mid infrared band.

Tests 8-9 of FIG. 7 show data indicative of the output that was produced from a 1×2×8 inch form factor-compatible, infrared flash flare of the invention. This data of tests 8-9 may be compared to the data of test 3, which is indicative of the output that was produced from a 1×2×8 inch form factor-compatible, infrared flash flare having a prior art flare geometry like that shown in FIGS. 1A-B. Tests 8-9 indicate that the infrared flash flares of the invention provided peak infrared outputs of at least about 106,004 w/ster in the short infrared band, as compared to only 27,192 w/ster provided by the prior art flare of test 3. Moreover, tests 8-9 indicate that the infrared flash flares of the invention provided peak infrared outputs of at least about 145,281 w/ster in the mid infrared band, in comparison to only 40,896 w/ster provided by the prior art flare of test 3. In addition to providing these peak infrared outputs, the infrared flash flares of tests 8-9 also produced peak light outputs of at least about 1,668,127 candela, in comparison to only 641,587 candela from the prior art flare of test 3. The differences in output and burn time are due, significantly in part, to the flare pellet assemblies of the invention having surface areas that are much greater than the surface areas of the prior art pellets (FIG. 1) for corresponding form factors. For example, for a 1×2×8 form factor, the surface area of a flare pellet assembly of the invention may be about 3.0 to about 4.5 times greater than the surface area of flare pellet 20 of FIG. 1.

Still referring to FIG. 7, it should be noted that the flare pellet geometry of test 4, like that of test 3, is like that shown in FIGS. 1A-B. However, the flare pellet utilized generate the output shown in test 4 is compatible with a 2×2.5×8 inch form factor, and therefore includes a significant amount more ignitable flare material than the 1×2×8 form factor pellets utilized to produce the output indicated in tests 8-9. Even though the conventional infrared flare of test 4 is substantially larger in size than the infrared flash flares of tests 8-9, which utilize the design of the present invention, the prior art infrared flare of test 4 failed to provide the peak outputs attained utilizing the flare pellet assembly design of the present invention.

FIG. 8 illustrates a flare assembly 100 that includes yet another embodiment of a flare pellet assembly of the invention, and accordingly, a "double prime" designation is utilized to distinguish the flare pellet assembly 30" shown in FIG. 8 from the flare pellet assemblies 30 and 30'. This flare assembly 100 has a first end 102, an opposing second end 104 from which the flare pellet assembly 30" is ejected, a reference axis 34, and a length 106 defined between the first and second ends 102, 104 measured parallel with the reference axis 34. In addition, an outer casing 108 of the flare assembly 100 is disposed about the pellet assembly 30" and along the substantial entirety of the length 106 of the flare assembly 100. This outer casing 108 may be made of any appropriate material such as, for example, aluminum.

Referring to FIGS. 8-9B, toward the second end 104 of the flare assembly 100 is a cap 110. The location of this cap 110 is such that it may be said that the flare pellet assembly 30" is disposed between the cap 110 and the second end 102 of the flare assembly 100. The cap 110 may be at least temporarily held in place in any of a number of appropriate manners. For example, the cap 110 may be adhesively interconnected with the outer casing 108 of the flare assembly 100 using an appropriate adhesive 112. In addition or alternatively, the cap 110 may be at least temporarily prevented from dissociating from the second end 104 by providing one or more retention stakes 114 in the outer casing 108. This cap 110 may be made of any appropriate material such as, for example, aluminum, plastic, and the like.

Referring specifically to FIG. 8, disposed toward the first end 102 of the flare assembly 100 is a number of components utilized to at least generally assist in launching/ejecting the flare pellet assembly 30" from a remainder of the flare assembly 100. Defined in the case 108 is an impulse cartridge port 113 having a shipping plug 109 disposed therein. Further, a piston 107 is disposed adjacent the impulse cartridge port 113. Also found between the first end 102 of the flare assembly 100 and the flare pellet assembly 30" is a sequencing igniter 111.

In operation, the flare assembly 100 of FIG. 8 may be said to function in the following manner. Prior to use, the flare assembly 100 may be inserted into a magazine (not shown) of a flare dispenser (not shown). The shipping plug 109 may be removed from the impulse cartridge port 113 of the case 108, and an appropriate impulse cartridge (not shown), such as an electro-explosive device, is inserted into the impulse cartridge port 113 of the case 108. This procedure may be repeated until a desired number of flare assemblies 100 is installed in the magazine. The magazine, with any other appropriate ancillary components (not shown), may then be engaged or associated with a flare dispenser (not shown).

To utilize the flare assembly 100, an electrical firing current is applied to electrical contacts of the impulse cartridge (not shown) which generally causes a resistance element internal to the impulse cartridge to heat and ignite its pyrotechnic compositions. A propellant charge in the impulse cartridge burns, and the resulting hot gasses and hot particles rupture a closure of the impulse cartridge pressurizing the free volume between the first end 102 of the flare case 108 and the piston 107. The hot gasses and hot particles from the impulse cartridge simultaneously flow through a spit hole 115 in the piston 107 and ignite a pyrotechnic pellet (not shown) that is internal to the pyrotechnic sequencing igniter 111. The pressure of the hot gasses in the free volume between the first end 102 of the case 100 and the piston 107 biases the piston toward the pyrotechnic sequencing igniter 115, which, in turn, is biased toward the flare pellet assembly 30", which then pushes against the closure 110 of the flare assembly 100. The forces exerted against the closure 110 are preferably great enough to override or overcome the retention of the closure 110 within the case 108. The pressure of the hot gasses behind the piston 107 continues to push against the above-mentioned components of the flare assembly 100, thus causing the flare pellet assembly 30" to be ejected from the case 108 of the flare assembly 100. Once clear of the case 108, bore rider portions of the pyrotechnic sequencing igniter 111 move outward (e.g., away from the reference axis 34) allowing a flame from the pyrotechnic pellet portion of the igniter 111 to impinge on an ignition material that the pellets 32" are coated with, thus igniting the stack of pellets 32" of the flare pellet assembly 30". In addition, pressure from the burning flare pellets 32" ruptures the protective wrap 72 of the flare pellet assembly 30" completing ignition/activation of the assembly 30". While FIG. 8 illustrates one appropriate design of a flare assembly 100 in which flare pellet assemblies of the invention (e.g., 30, 30', 30") may be utilized, it should be noted that the flare pellet assemblies herein described may be employed in any appropriate flare launcher and/or flare assembly.

Still referring to the flare pellet assembly 30" of the flare assembly 100 of FIG. 8, a plurality of flare pellets 32" are arranged in a stack at least generally along a longitudinal reference axis 34, and the flare pellet assembly 30" includes an aperture 36, a rod 62, and a nut 68 like those described above. Each of these flare pellets 32" may be made of an appropriate ignitable material described herein as well as those ignitable materials described in U.S. Pat. No. 5,472,533 to Herbage et al, the entire disclosure of which is herein incorporated in its entirety.

Figure 10A:
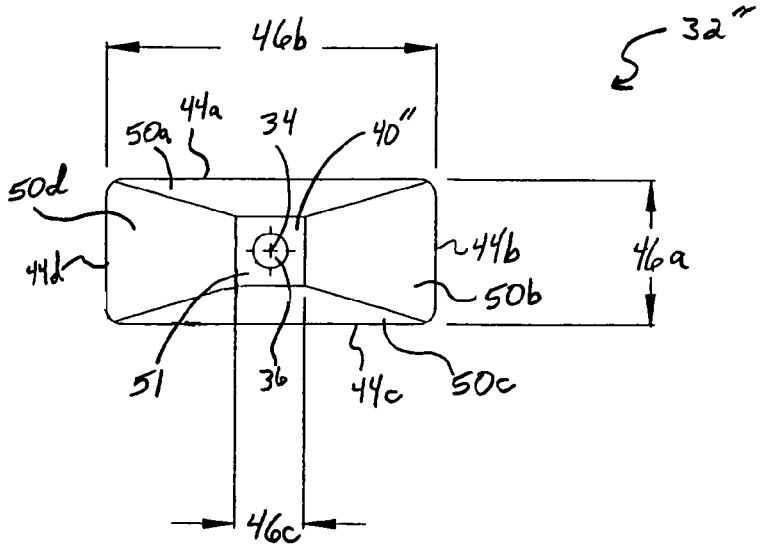
FIG. 10A is top view of a flare pellet of the flare pellet assembly of FIG. 8.
Figure 10B:
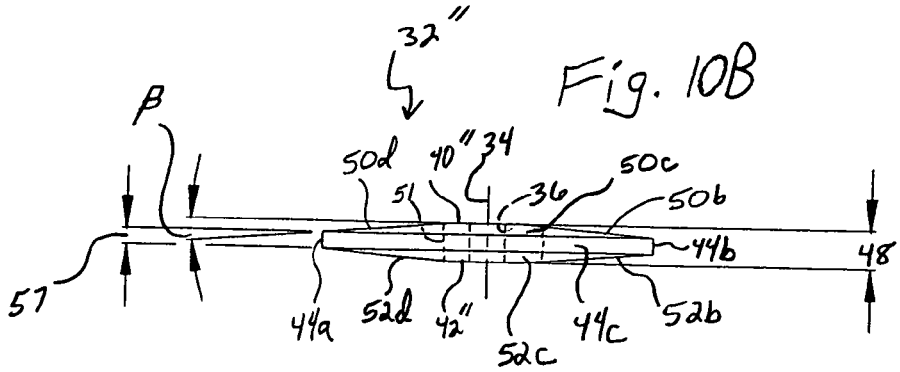
FIGS. 10B-C are side views of the flare pellet of FIG. 10A.
Figure 10C:
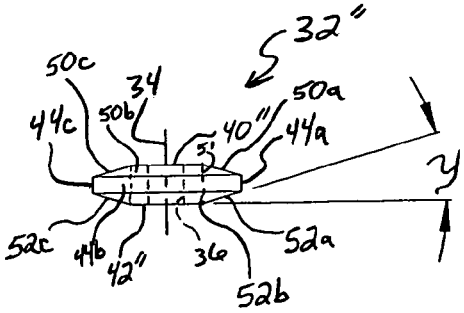

FIGS. 10A-C illustrate an exemplary flare pellet 32" of the flare pellet assembly 30". Unlike the flare pellets 32, 32', this flare pellet 32" has an at least generally rectangular cross-sectional shape when taken perpendicular to the reference axis 34. In addition, this flare pellet 32" includes a top 40", a bottom 42", and first, second, third, and fourth sides 44*a*, 44*b*, 44*c*, and 44*d* (respectively). A first width 46*a* of the flare pellet 32" extends between the first and third sides 44*a*, 44*c* of the flare pellet 32" and is generally measured substantially perpendicular to the reference axis 34. Similarly, a second width 46*b* of the flare pellet 32" extends between the second and fourth sides 44*b*, 44*d* of the flare pellet 32" and is generally measured substantially perpendicular to the reference axis 34. These first and second widths 46*a*, 46*b* may be any appropriate widths. For example, in one preferred embodiment, the first width 46 is about 0.845 inch and the second width is about 1.880 inches. In addition to these widths 46*a*, 46*b*, the flare pellet 32" also has a length 48 measured substantially parallel to the reference axis 34 that generally coincides with a distance between the top 40" and the bottom 42" of the flare pellet 32". This length 48 may be any appropriate length and, in one preferred embodiment, is about 0.225 inch.

Still referring to FIGS. 10A-C, in addition to the top 40, bottom 42, and sides 44*a-d*, the flare pellet 32" also includes first, second, third, and fourth upper outer surfaces 50*a*, 50*b*, 50*c*, and 50*d* (respectively), and first, second, third, and fourth lower outer surfaces 52*a*, 52*b*, 52*c*, and 52*d* (respectively). The first upper outer surface 50*a* at least generally extends between the top 40" and the first side 44*a* of the flare pellet 32". Likewise, the second upper outer surface 50*b* at least generally extends between the top 40" and the second side 44*b* of the flare pellet 32", the third upper outer surface 50*c* at least generally extends between the top 40" and the third side 44*c*, and the fourth upper outer surface 50*d* at least generally extends between the top 40" and the fourth side 44*d*. Moreover, the first lower outer surface 52*a* at least generally extends between the bottom 42" and the first side 44*a* of the flare pellet 32", the second lower outer surface 52*b* at least generally extends between the bottom 42" and the second side 44*b*, the third lower outer surface 52*c* at least generally extends between the bottom 42" and the third side 44*c*, and the fourth lower outer surface 52*d* at least generally extends between the bottom 42" and the fourth side 44*d*.

The above-described upper and lower outer surfaces 50*a-d*, 52*a-d* of FIGS. 10A-C are configured such that it may be said that the flare pellet 32" at least generally tapers from a first central portion 51 of the flare pellet 32" toward the sides 44*a-d* of the flare pellet 32". Incidentally a width 46*c* of this central portion 51, which also coincides with a width of the top 40" and bottom 42", may be any of a number of appropriate distances, and, in one preferred embodiment, is about 0.400 inch. It may be said that flare pellet 32" at least generally narrows from it length 48, found at the central portion 51, to a side length 57 measured at any of the sides 44*a-d* of the flare pellet 32". As another way of stating this, and as a more particular statement, the upper and lower surfaces 50*a-d*, 52*a-d* are oriented at angles greater than 0° and less than 90° relative to a plane parallel with one or both the top 40" and bottom 42". For instance, the first and third upper and lower surfaces 50*a*, 50*c*, 52*a*, 52*c* may be oriented at an angle "β" of about 5°. As another example, the second and fourth lower surfaces 50*b*, 50*d*, 52*b*, 52*d* may be oriented at an angle "γ" of about 16.3°. In some embodiments, one or more of the upper and lower outer surfaces 50*a-d*, 52*a-d* may be oriented at differing angles compared to the others. So, for instance, in one embodiment, all of the upper and lower outer surfaces 50*a-d*, 52*a-d* may exhibit differing angles relative to a plane parallel with one or both the top 40" and bottom 42" of the flare pellet 32".

Figure 11:
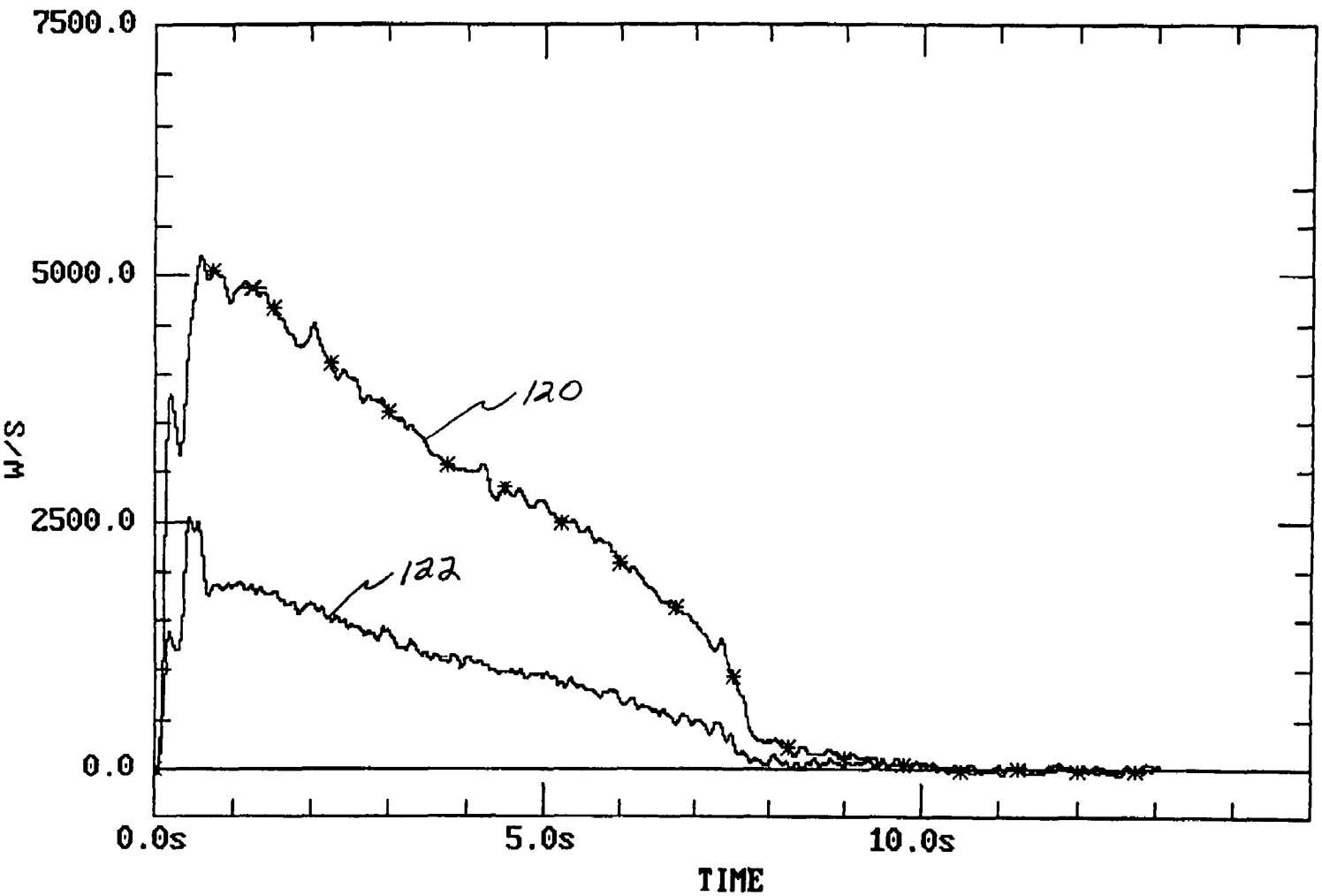
FIG. 11 is a graph illustrating spectral output of a conventional prior art spectrally balanced flare pellet.
Figure 12:
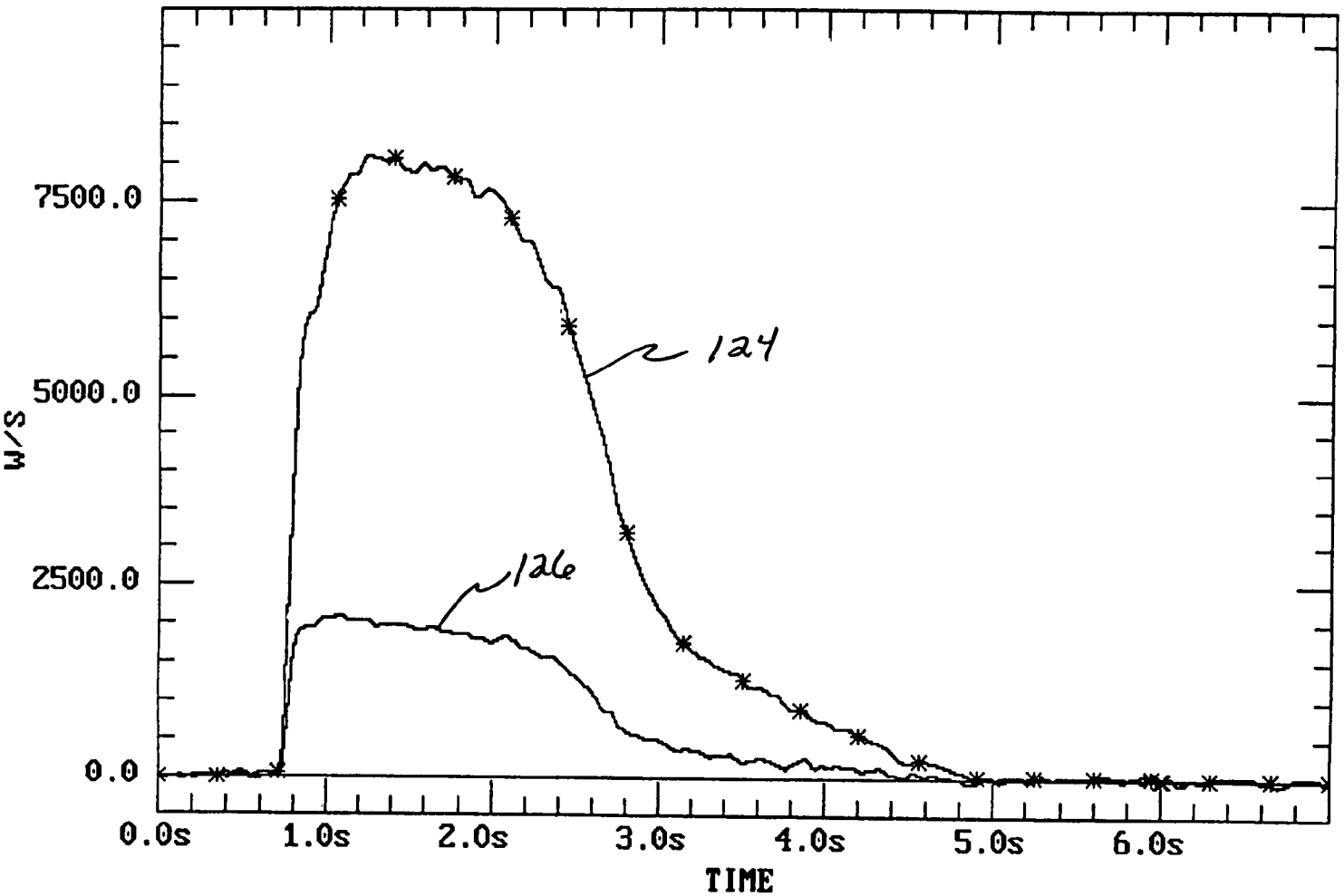
FIG. 12 is a graph illustrating spectral output of the flare pellet assembly of FIG. 8.

FIG. 11 is a graph showing first and second outputs 120, 122 (respectively) of a spectrally balanced prior art flare having a geometry like that shown in FIGS. 1A-B and having a 1×2×8 form factor. By comparison, FIG. 12 is a graph showing third and fourth outputs 124, 126 (respectively) of an embodiment of the flare pellet assembly 30" having a 1×2×8 form factor and including the same ignitable composition as the flare pellet that was utilized to generate the output of FIG. 11. The output shown in FIG. 11 illustrates that the corresponding flare's burn lasted for about 8 10 seconds, as opposed to the about 5 second burn time shown in FIG. 12. This is due to the increased surface area of the FIG. 12 flare pellet (e.g., 32" of FIG. 9) relative to the FIG. 11 flare pellet (e.g., 20 of FIG. 1). Another way of stating this is that the shorter burn time illustrated in FIG. 12 is due to a smaller flare pellet web than the flare pellet web affecting the burn time shown in FIG. 11. Since the burn time of FIG. 12 is shorter than that of FIG. 11, the third output 124 is significantly greater than the first output 120 in the mid infrared band between about 0.8 seconds after ignition and about 2.8 seconds after ignition. Moreover, the fourth output 126 is, in most cases, generally equal to or greater than the second output 122 in the short infrared band and roughly in about the same time frame. Since infrared guided missiles may be appropriately decoyed away with a burn of only about 2-3 seconds, this greater output of FIG. 12 may more closely resemble an exhaust plume of an aircraft and may be more effective than the flare of FIG. 11. This shorter burn time and greater output has previously been unattainable as prior attempts at providing a flare pellet with such output have resulted in flare pellets with degraded spectral ratios (e.g., attempting to formulate faster burning compositions) and/or structural instability (e.g., could not withstand flight vibration without chipping, cracking, and/or breaking).

Figure 13:
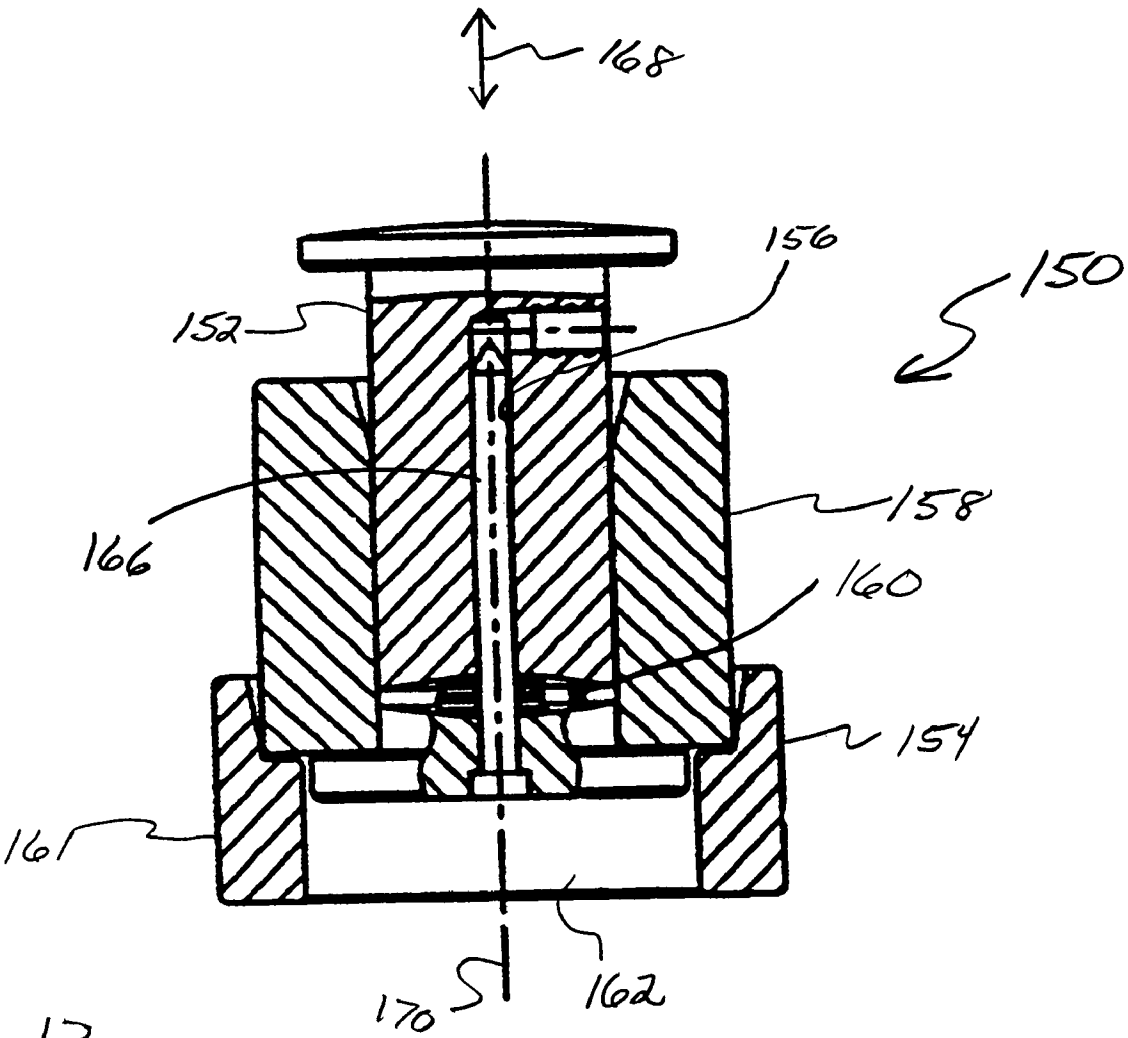
FIG. 13 is a cross-section view of a press and die for making flare pellets associated with the invention.

FIG. 13 illustrates one example of a device 150 that may be utilized in making the individual flare pellets (e.g., 32, 32', 32"). This device 150 may be characterized as having a punch 152 and anvil 164. The punch 152 of the device 150 is generally a solid structure, except for a core rod receptacle 156 defined therein. The anvil 164 of the device 150 includes a sleeve 158 to at least generally assist in keeping a pellet precursor material 160 from leaking out from sides of the device 150.

To make a flare pellet assembly, such as any of the flare pellet assemblies described herein, the removable sleeve 158 is associated with the device 150. Then, a pre-measured charge of one or more ignitable materials, or flare pellet precursor material 160, is loaded at least generally into the sleeve 158. At or before this point, it is desirable to have the anvil 164 and core rod 166 preassembled together with the sleeve 158. The punch 152 is assembled to the tooling with the core rod 166 nesting up into the receptacle 156 defined in the punch 152. The charged tooling is then placed on a press 162 (usually a hydraulic press). The press 162 is energized, and the press biases at least one of the punch 152 and the anvil 164 toward the other at least generally in one of the directions indicated by arrow 168, thus forming the flare pellet precursor material 160 into a pellet. The press 162 is then retracted, and the tooling removed. The punch 152 and the anvil/core rod 166 are then removed from the tooling leaving the flare composition pellet in the sleeve 158. The sleeve 158 is then again placed on a push out sleeve 154 of the device 150, and the punch 152 is again directed into the sleeve 158. The tooling is then placed back into the press 162, and the action of the press 162 is used to push the flare pellet out of the sleeve 158.

While FIG. 13 illustrates one device for making flare pellets, other appropriate manners including, but not limited to, extrusion, molding, and/or casting of flare pellets may also be utilized to form a plurality of flare pellets. In any event, once these individual flare pellets are fabricated, the same are stacked to form a pellet assembly (e.g., 30), and an appropriate casing (e.g., 72) is disposed about at least a portion of the pellet assembly.

Various manners of forming usable pellets may depend on the pyrotechnic or even potentially pyrophoric compositions being utilized. For instance, some compositions can be formed into pellets by pressing and typically not by extruding or casting. Other compositions may be formed into pellets by casting only, while others may be suitable for extruding, and still others by pressing and extruding. As a more particular example, the spectrally balanced flare compositions and the visible light flare compositions described herein may be pressed to form a pellet, while the MTV composition used for infrared flash flares may be pressed or extruded. It should be noted, however, that any appropriate manner of forming any appropriate composition(s) into flare pellets is included within the scope of this disclosure.

Again, one of the objects of the invention is to provide a flare pellet geometry that provides a thinner web (e.g., distance between peripheral surfaces of the flare pellet and a geometric center of the same) than can be obtained using conventional fabrication methods. The thin web design of the flare pellets, with their attendant high initial surface areas, at least generally promote a rapid, high-intensity burn that may be tailored or controlled to mimic a spectral signature of an aircraft exhaust plume. Accordingly, the web thickness may be no more than about 0.20 inch in one embodiment, no more than about 0.17 inch in another embodiment, no more than about 0.15 inch in still another embodiment, and no more than about 0.12 inch in yet another embodiment.

The flare pellets (e.g., 32, 32', 32") of the invention are typically thinner at the outer edges than in the center. When assembled in a stack as a flare pellet assembly (e.g., 30, 30', 30"), this difference in thickness from the central portion to the outer edges defines grooves between adjacent flare pellets to which ignition materials may be applied and, upon ignition of the flare pellet assembly, allows relief for rapid escape of hot gasses. In other words, the stacked pellet configuration provides a significantly larger surface area available for combustion than conventional designs. For example, the prior art flare pellet 20 shown in FIG. 1 has a surface area per gram of flare composition of only about 0.283 sq in./g. By contrast, the flare pellet assemblies of the invention exhibit surface areas per gram of flare composition of about 0.76 sq in./g in one embodiment and about 0.85 sq in./g in another embodiment. This larger than normal surface area promotes the rapid burning of the flare pellet assembly yielding increased mass flow and resultant higher than normal energy output for a shorter overall period of time. A shape of the time versus intensity energy output curve can be modified to suit the intended application by varying, among other things, any of the geometric features, some of which are:

1) the thickness of one or more of the pellets in the stack;

2) the number of pellets in a given form factor;

3) the radii of the bi-convex pellet surfaces;

4) the angle(s) of the various surfaces (e.g., 50, 50', 50*a-d*, 52, 52', 52*a-d*); and 5) the dimensions of the central portions of one or more pellets.

When assembled, the stack of pellets provide a rapid burning substitute for a conventional flare pellet. The assembly can then be prepared and assembled into any standard form factor flare case, along with any appropriate ancillary flare hardware, to yield a completed flare that can be fired using any appropriate flare launcher system.

Those skilled in the art will now see that certain modifications can be made to the assembly and related methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims. For instance, while the invention has been disclosed in regard to aircraft defensive countermeasures, the invention may have application in pyrotechnic devices at least generally associated with naval and/or land vehicles.

What is claimed is:

1. A pyrotechnic flare pellet assembly for providing at least one of visual and infrared energy output comprising:

a plurality of ignitable pyrotechnic flare pellets arranged in a stack;

a means for joining said stack of said plurality of pellets whereby said stack remains joined upon ejection from a flare launcher;

each of said plurality of pellets having tapered edges whereby the center of each of said plurality of pellets is thicker than the edges of the pellet; and a plurality of tapered grooves defined between said tapered edges of said pellets, said plurality of tapered grooves axially aligned with a longitudinal axis of said stack and disposed about the circumference of said stack.

2. The pyrotechnic flare pellet assembly of claim 1 further comprising:

said means is a rod that extends through said pellet assembly.

3. The pyrotechnic flare pellet assembly of claim 2 further comprising:

said means is an adhesive intermediate to said rod and said pellets.

4. The pyrotechnic flare pellet assembly of claim 2 further comprising:

said means is an adhesive intermediate to said pellets.

5. The pyrotechnic flare pellet assembly of claim 3 further comprising:

said means is a wrap disposed about said stack of pellets.

6. The pyrotechnic flare pellet assembly of claim 1 further comprising:

said plurality of pellets are disk shaped.

7. The pyrotechnic flare pellet assembly of claim 1 further comprising:

said plurality of pellets are shaped in the form of a frustum.

8. The pyrotechnic flare pellet assembly of claim 1 further comprising:

each of said plurality of tapered grooves having an interior angle of between about 5° and about 35°.

9. The pyrotechnic flare pellet assembly of claim 1 further comprising:

said plurality of pellets are substantially identical in size and design.

10. The pyrotechnic flare pellet assembly of claim 1 further comprising:

said plurality of pellets are bi-convex disks.

* * * * *